US007958865B2

(12) United States Patent
Ichikawa et al.

(10) Patent No.: US 7,958,865 B2
(45) Date of Patent: Jun. 14, 2011

(54) ENGINE INTAKE CONTROL SYSTEM

(75) Inventors: Kenji Ichikawa, Tochigi (JP); Tamikazu Mukasa, Tochigi (JP); Koichi Okushima, Tochigi (JP)

(73) Assignee: Keihin Corporation, Tokyo (JP)

( * ) Notice: Subject to any disclaimer, the term of this patent is extended or adjusted under 35 U.S.C. 154(b) by 904 days.

(21) Appl. No.: 11/314,204

(22) Filed: Dec. 22, 2005

(65) Prior Publication Data

US 2006/0157027 A1 Jul. 20, 2006

(30) Foreign Application Priority Data

Dec. 22, 2004 (JP) ..... 2004-370742

(51) Int. Cl.
*F02D 11/10* (2006.01)
*F02D 9/08* (2006.01)

(52) U.S. Cl. ..... 123/337; 123/399

(58) Field of Classification Search ..... 123/337, 123/399; 251/305
See application file for complete search history.

(56) References Cited

U.S. PATENT DOCUMENTS

| | | | | |
|---|---|---|---|---|
| 6,491,019 | B1 * | 12/2002 | Apel | 123/337 |
| 6,883,494 | B2 * | 4/2005 | Kurita et al. | 123/337 |
| 6,886,806 | B2 * | 5/2005 | Borasch et al. | 251/305 |
| 2004/0119041 | A1 * | 6/2004 | Kawai et al. | 251/305 |

FOREIGN PATENT DOCUMENTS

| | | |
|---|---|---|
| DE | 100 48 937 A1 | 4/2002 |
| JP | 2004-124718 | 4/2004 |
| JP | 2004-162679 | 6/2004 |
| JP | 2004-293452 | 10/2004 |

* cited by examiner

*Primary Examiner* — Hai Huynh
(74) *Attorney, Agent, or Firm* — Arent Fox LLP

(57) ABSTRACT

A transmitting case includes a first case half integrally formed on one side of a throttle body, and a second case half coupled to the first case half. A first assembly is constructed by disposing a final gear inside the first case half and securing it to one end of a valve shaft. A second assembly is constructed by mounting on the second case half an electric motor and an intermediate gear of a speed reduction device for transmitting the rotation of an output shaft of the electric motor to the final gear. Upon coupling of the first case half and the second case half, the intermediate gear and the final gear are meshed with each other. Thus, there is provided an engine intake control system having an excellent assemblability and an improved accuracy of throttle valve opening degree.

8 Claims, 3 Drawing Sheets

ENGINE INTAKE CONTROL SYSTEM

RELATED APPLICATION DATA

The present invention is based upon Japanese priority application No. 2004-370742, which is hereby incorporated in its entirety herein by reference.

BACKGROUND OF THE INVENTION

1. Field of the Invention

The present invention relates to an engine intake control system which is mounted on a motorcycle, an automobile, an outboard engine system and the like, and particularly to an engine intake control system comprising: an intake passage leading to an intake port of an engine; and an electric motor disposed on one side of a throttle body which rotatably supports a valve shaft of a throttle valve for opening and closing the intake passage, an output shaft of the electric motor being connected to the valve shaft through a speed reduction device for reducing the rotation of the output shaft and transmitting it to the valve shaft.

2. Description of the Related Art

German Patent Application Laid-open No. 10048937A1 discloses an engine intake control system, in which a speed reduction device is housed in a transmitting case to which an electric motor is mounted, and when the transmitting case is coupled to a throttle body, a valve shaft of a throttle valve supported in the throttle body is connected to an output portion of the speed reduction device.

In the conventional engine intake control system disclosed in German Patent Application Laid-open No. 10048937A1, it is possible to assemble, in parallel, a throttle body assembly comprising the throttle body and the throttle valve, and a transmitting case assembly comprising the transmitting case, the electric motor and the speed reduction device, leading to a good assemblability. However, the engine intake control system has the following disadvantages: the throttle body and the transmitting case are constructed completely separately from each other, so that when the throttle body and the transmitting case are coupled to each other, the resulting device tends to be large; and the generation of chattering is not avoided between the valve shaft and the speed reduction device connected to each other upon such coupling. Therefore, there is an insufficient accuracy in the opening degree of the throttle valve by the electric motor.

SUMMARY OF THE INVENTION

Accordingly, it is an object of the present invention to provide a compact engine intake control system having an excellent assemblability and an improved accuracy in an opening degree of a throttle valve.

In order to achieve the above subject, according to a first feature of the present invention, there is provided an engine intake control system comprising: an intake passage leading to an intake port of an engine; and an electric motor disposed on one side of a throttle body which rotatably supports a valve shaft of a throttle valve for opening and closing the intake passage, an output shaft of the electric motor being connected to the valve shaft through a speed reduction device for reducing the rotation of the output shaft and transmitting it to the valve shaft, wherein the system further comprises a transmitting case including a first case half integrally formed on one side of the throttle body, and a second case half coupled to the first case half; wherein a first assembly is constructed by disposing a final gear inside the first case half and securing it to one end of the valve shaft; wherein a second assembly is constructed by mounting on the second case half the electric motor and an intermediate gear of the speed reduction device for transmitting the rotation of the output shaft of the electric motor to the final gear; wherein the first case half and the second case half are coupled to each other to connect together the first and second assemblies, and wherein the intermediate gear and the final gear are meshed with each other.

With the first feature of the present invention, in assembling the engine intake control system, the first assembly constructed by disposing the final gear inside the first case half and securing it to the one end of the valve shaft, and the second assembly constructed by mounting on the second case half the electric motor and the intermediate gear of the speed reduction device for transmitting the rotation of the output shaft of the electric motor to the final gear, are assembled in parallel; thereafter, the second case half is coupled to the first case half to complete the assembling. Therefore, the assembling can be conducted with a good efficiency.

In addition, the intermediate gear and the final gear are meshed with each other simultaneously with the coupling of the case halves. Therefore, it is possible to further increase the efficiency of the assembling and to suppress chattering between the speed reduction device and the valve shaft as much as possible, thereby increasing the accuracy of the control of the opening degree of the throttle valve by the electric motor.

Further, since the first case half of the transmitting case is integrally formed with the throttle body, a portion of the transmitting case is shared by the throttle body, thereby providing a compactness of the engine intake control system.

According to a second feature of the present invention, in addition to the first feature, the second case half is divided into a case member which supports the electric motor and houses the intermediate gear, and a cover coupled to the case member so as to cover an outer surface of the case member; and at least one of the case member and the cover is made of a synthetic resin.

With the second feature of the present invention, the second case half is divided into the case member which supports the electric motor and houses the intermediate gear, and the cover coupled to the case member to cover the outer surface of the case member. Therefore, it is possible to facilitate the molding of the case member and the cover to easily produce the second case half. In this case, at least one of the case member and the cover is made of synthetic resin, thereby further facilitating the molding thereof to contribute to cost reduction.

According to a third feature of the present invention, in addition to the second feature, a throttle sensor is constructed by a sensor rotor secured to the final gear and a sensor stator attached to the cover to detect the opening degree of the throttle valve through the sensor rotor; and the cover is provided with a power feeding circuit and a connector which connects a current-carrying terminal of the electric motor to the power feeding circuit upon coupling of the cover and the case member.

With the third feature of the present invention, the final gear having the sensor rotor secured thereto is integral with the valve shaft of the throttle valve. Therefore, the sensor stator attached to the cover can accurately detect the opening degree of the throttle valve through the sensor rotor, and the electric motor can accurately control the opening degree of the throttle valve based on a detection signal from the sensor stator.

In addition, when the case member and the cover constituting the second case half are coupled to each other, the current-carrying terminal of the electric motor is connected to the power feeding circuit by the connector. Therefore, it is possible to eliminate a special step of connecting the electric motor to the power feeding circuit, and to prevent forgetting of connecting them, leading to an improvement in assemblability.

According to a fourth feature of the present invention, in addition to any of the first to third features, the first case half is provided with a fully-closing stopper for receiving a stopper face formed on the final gear to define a fully-closed position of the throttle valve.

With the fourth feature of the present invention, the fully-closed position of the throttle valve is defined by the abutment between the stopper integral with the throttle body and the stopper face of the final gear integral with the valve shaft of the throttle valve. Therefore, the fully-closed position of the throttle valve is always stable, and hence it is possible to accurately provide an idling opening degree of the throttle valve determined on the basis of the fully-closed position. This can contribute to a reasonable idling of the engine, and further to a reduction in fuel consumption.

According to a fifth feature of the present invention, in addition to any of the first to fourth features, the throttle body is integrally formed with a bracket which supports an end of the electric motor upon coupling of the first and second case halves.

With the fifth feature of the present invention, the end of the electric motor is supported utilizing the throttle body, so that the generation of vibrational noise of the electric motor can be suppressed during operation of the electric motor.

The above and other objects, features and advantages of the invention will become apparent from the preferred embodiment described in reference to the accompanying drawings.

DETAILED DESCRIPTION OF THE PREFERRED EMBODIMENT

The present invention will now be described by way of a preferred embodiment shown in the accompanying drawings.

Figure 1:
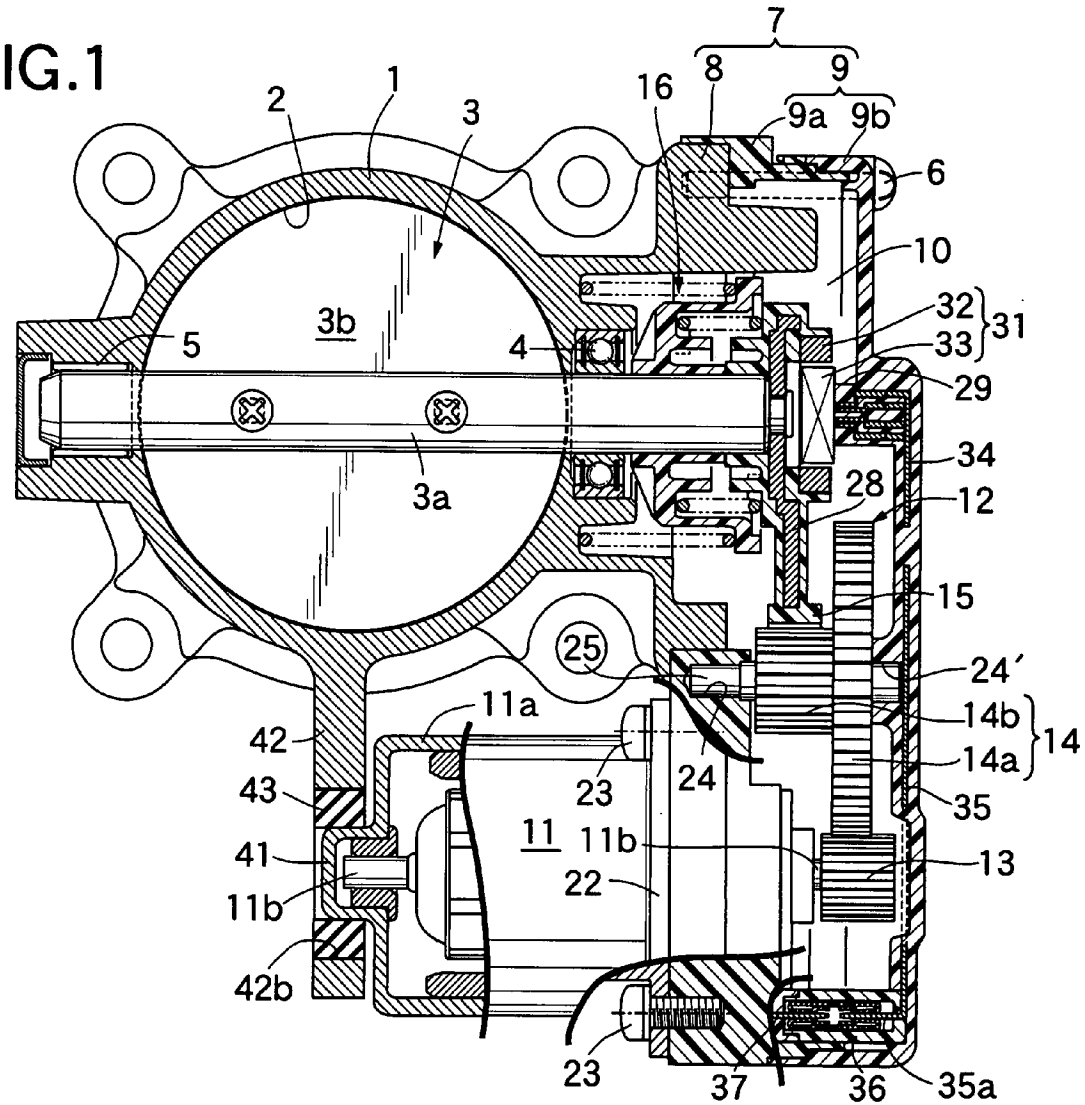
FIG. 1 is a plan view of an engine intake control system according to an embodiment of the present invention.
Figure 2:
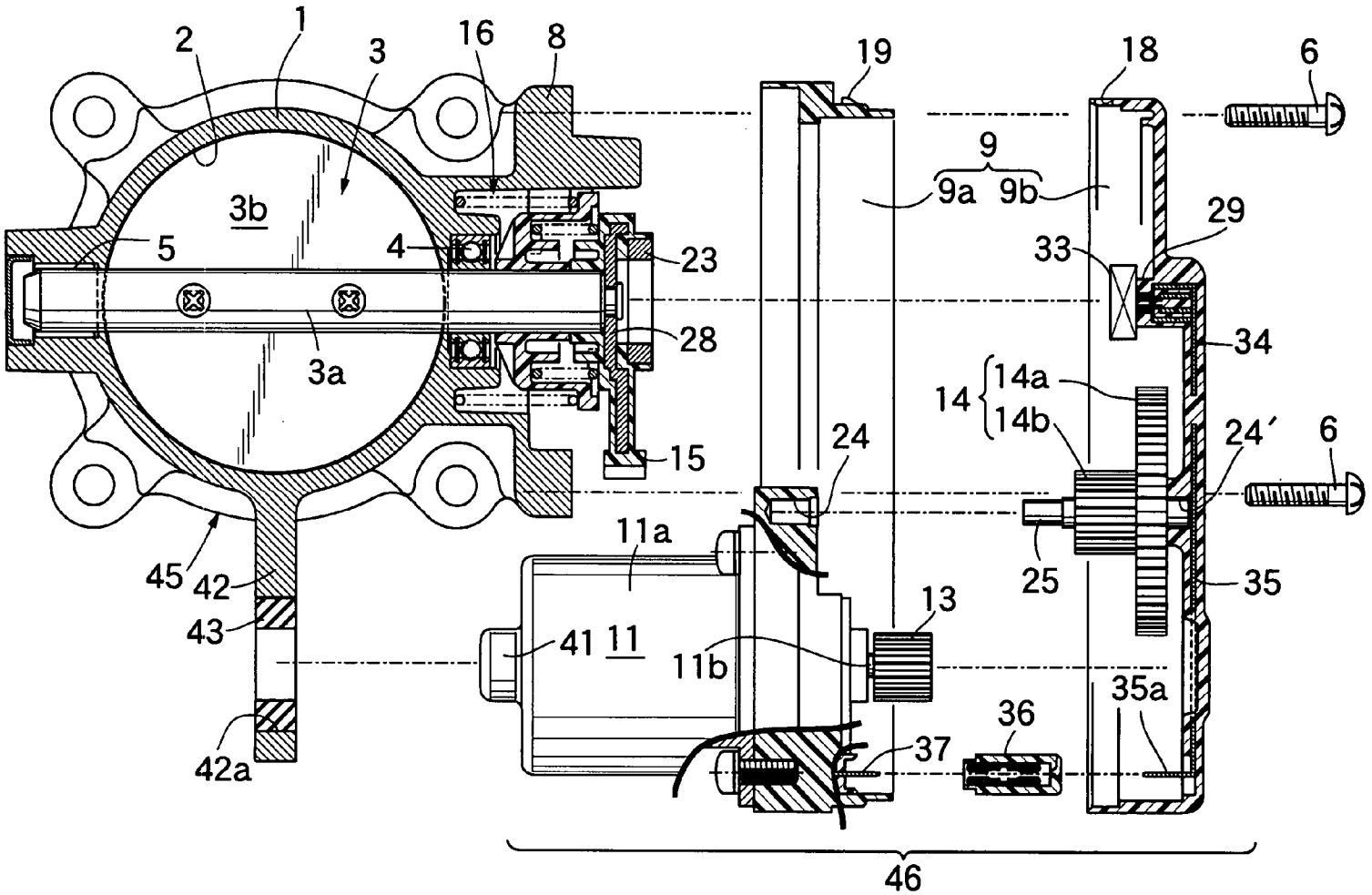
FIG. 2 is an exploded vertical sectional side view of the engine intake control system.
Figure 3:
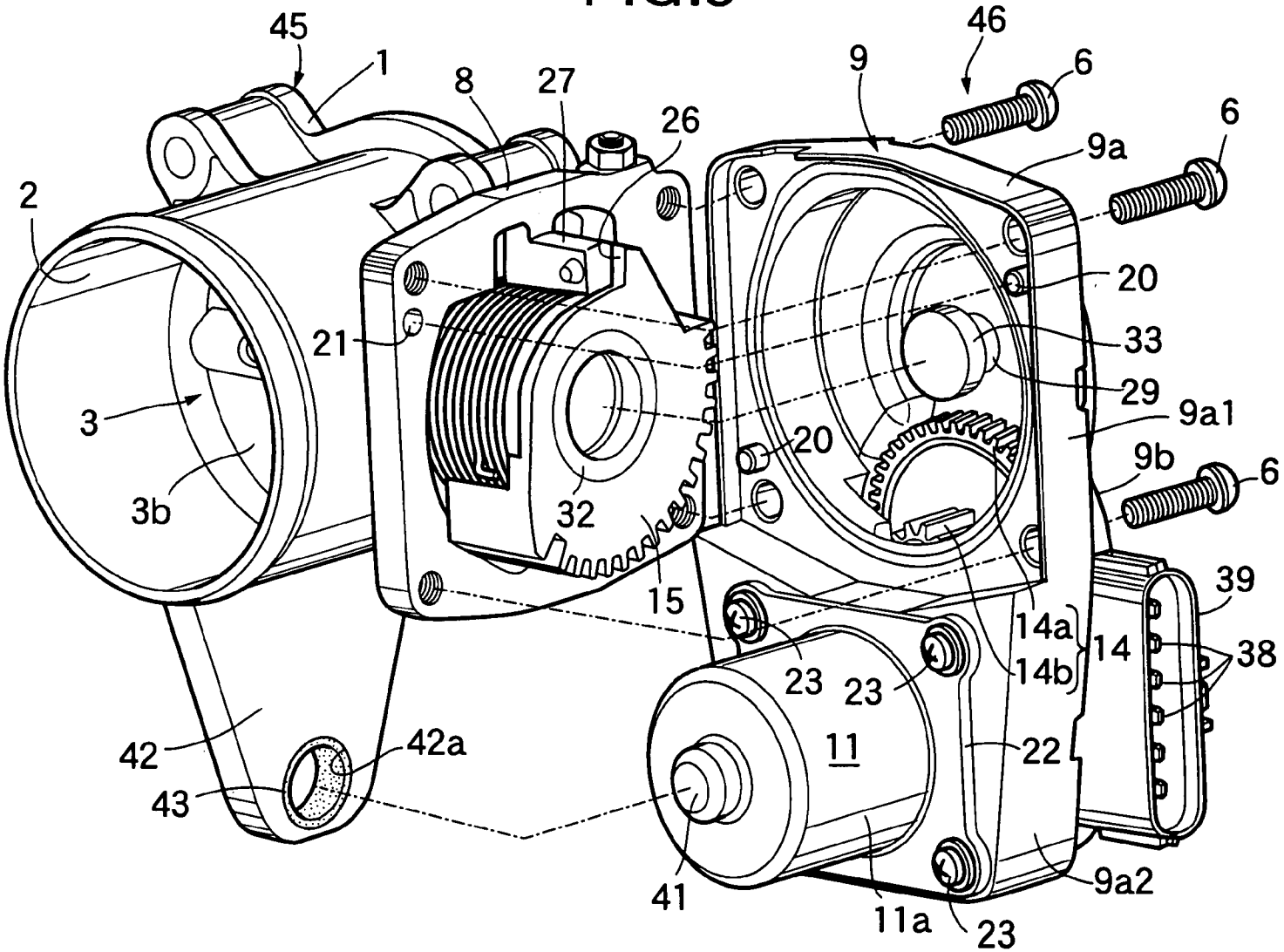
FIG. 3 is an exploded perspective view showing the engine intake control system with first and second assemblies separated from each other.

Referring to FIGS. 1 to 3, a throttle body 1 made of a light metal and connected to an intake system mounted on an automobile or a motorcycle includes: an intake passage 2 leading to an intake port of an engine; and a throttle valve 3 mounted in the throttle body 1 to open and close the intake passage 2. The throttle valve 3 is constructed into a butterfly type, including: a valve shaft 3*a* mounted to traverse the intake passage 2 and rotatably supported on left and right opposite sidewalls of the throttle body 1 with a bush 5 and a ball bearing 4 interposed therebetween; and a valve plate 3*b* mounted to the valve shaft 3*a* within the intake passage 2.

A first case half 8 is integrally formed on one side of the throttle body 1, on which one end of the valve shaft 3*a* protrudes. A transmitting case 7 is constructed by the first case half 8, and a second case half 9 which is separateably coupled to the first case half 8 by a plurality of bolts 6. Both the case halves 8 and 9 define a transmitting chamber 10 therebetween.

As shown in FIGS. 2 and 3, the second case half 9 comprises: a case member 9*a* having an annular portion $9a_1$ corresponding to the first case half 8 and a motor-supporting portion $9a_2$ leading to one end of the annular portion $9a_1$; and a cover 9*b* fitted over an outer periphery of an outer portion of the case member 9*a* to cover an outer surface of the case member 9*a*. The case member 9*a* and the cover 9*b* are coupled to each other by snap-engaging a plurality of locking claws 19 formed on the other fitting portion into a plurality of locking bores 18 formed in one of fitting portions. In this case, a pair of positioning pins 20, 20 are projectingly provided on one of the coupled surfaces of the case halves 8 and 9 so as to be in line with each other on a diagonal line of such coupled surface; and a plurality of positioning bores 21 are provided in the other coupled surface so that the positioning pins 20, 20 are fitted into the positioning bores 21. Each of the case member 9*a* and the cover 9*b* is made of a synthetic resin.

A mounting flange 22 formed at one end of a stator 11*a* of an electric motor 11 is secured to the motor-supporting portion $9a_2$ of the case member 9*a* of the second case half 9 by a plurality of bolts 23. A speed reduction device 12 adapted to reduce the rotation of a rotor shaft 11*b*, i.e., an output shaft of the electric motor 11 and transmit it to the valve shaft 3*a*, is accommodated in the transmitting chamber 10. The speed reduction device 12 comprises: a pinion gear 13 fixedly mounted on the output shaft 11*b* of the electric motor 11; an intermediate gear 14 including a larger-diameter gear portion 14*a* meshed with the pinion gear 13, and a smaller-diameter gear portion 14*b* formed coaxially and integrally with the larger-diameter gear portion 14*a*; and a larger-diameter final gear 15 connected to the valve shaft 3*a* and meshed with the smaller-diameter gear portion 14*b*. The intermediate bear 14 is rotatably supported on a support shaft 25 which is supported by being fitted at its opposite ends in a support bores 24 and 24' in the case member 9*a* and the cover 9*b*. In this case, the support shaft 25 serves as a positioning member for defining the coupling position of the case member 9*a* and the cover 9*b* by being fitted into the supporting bores 24 and 24', thereby contributing to an appropriate meshing between the pinion gear 13 and the larger-diameter gear portion 14*a* of the intermediate gear 14.

As shown in FIG. 3, the final gear 15 is of a sector-shape and has a stopper face 26 formed at one end thereof. A fully-closing stopper 27 is integrally formed on the first case half 8 and adapted to receive the stopper 26 to define a fully-closed position of the throttle valve 3.

A return spring mechanism 16 is housed in the first case half 8. The return spring mechanism 16 has a default function to bias the final gear 15 in a direction to close the throttle valve 3, and to retain the throttle valve 3 at a predetermined opening degree when the electric motor 11 is not operated.

The final gear 15 is made of a synthetic resin, and a metal core plate 28 secured by crimping to the valve shaft 3*a* is mold-bonded within the final gear 15. A sensor rotor 32 comprising an annular magnet arranged coaxially with the valve shaft 3*a* is fixedly mounted in the final gear 15. The sensor rotor 32 has an inner peripheral surface exposed, and a sensor stator 33 is mounted to a sensor-supporting portion 29 integral with the cover 9*b* so as to face the inner peripheral surface. The sensor stator 33 comprises a magnetronic converting element such as a Hall element and a magnetic resistance element. A throttle sensor 31 is constructed by the sensor rotor 32 and the sensor stator 33 so that the sensor stator 33 detects the opening degree of the throttle valve 3 through the sensor rotor 32.

A signal circuit 34 leading to an output portion of the sensor stator 33 and a power feeding circuit 35 are embedded in the cover 9*b*. A coupler 39 is formed integrally with the cover 9*b* to retain a plurality of connection terminals 38 leading to the signal circuit 34 and the power feeding circuit 35. A connector 36, to which a terminal 35*a* of the power feeding circuit 35 is connected, is fittedly provided in the cover 9*b*. A current-carrying terminal 37 of the electric motor 11 is connected to the connector 36 upon coupling of the case member 9*a* and the cover 9*b*. Therefore, the power feeding circuit 35 and the electric motor 11 are connected to each other through the connector 36.

As shown in FIG. 1, a boss 41 for supporting a bearing member 40 which supports an end of the rotor shaft 11*b* is integrally and projectingly provided on an end face of the stator 11*a* of the electric motor 11 opposite from the mounting flange 22. The boss 41 is fitted and supported in a support bore 42*a* in a bracket 42 integrally formed on the throttle body 1, with an elastic member 40 interposed therebetween.

As shown in FIGS. 2 and 3, in the above-described arrangement, a first assembly 45 is constructed by the throttle body 1 including the first case half 8, the throttle valve 3, the final gear 15, the return spring mechanism 16 and the sensor rotor 32; and a second assembly 46 is constructed by the second case half 9 (the case member 9*a* and the cover 9*b*), the electric motor 11, the pinion gear 13, the intermediate gear 13 and the sensor stator 33. Thus, when the first and second case halves 8 and 9 are coupled to each other, the intermediate gear 13 and the final gear 15 are meshed with each other, and the boss 41 of the electric motor 11 is fitted into the support bore 42*a* in the bracket 42 with the elastic member 40 interposed therebetween.

The operation of this embodiment will be described below.

To assemble the engine intake control system, as shown in FIG. 3, the first assembly 45 and the second assembly are assembled in parallel. Thereafter, the second case half 9 of the second assembly 11 is coupled to the first case half 8 of the first assembly 45 by the plurality of bolts 6, thereby completing the assembling. Therefore, the assembling can be conducted efficiently.

Simultaneously with the coupling of the case halves 8 and 9, the intermediate gear 13 and the final gear 15 are meshed with each other, and the boss 42 of the electric motor 11 is fitted into the support bore 42*a* in the bracket 42 with the elastic member 40 interposed therebetween. Therefore, it is possible to further enhance the efficiency of assembling.

Since the first case half 8 of the transmitting case 7 is integrally formed on the throttle body 1, a portion of the transmitting case 7 is shared by the throttle body 1, thereby achieving a compactness of the engine intake control system.

The second case half 9 is divided into the case member 9*a* which supports the electric motor 11 and houses the intermediate gear 13; and the cover 9*b* coupled to the case half 9*a* to cover the outer surface of the case half 9*a*, each of the case member 9*a* and the cover 9*b* being made of the synthetic resin. Therefore, it is possible to facilitate the molding of the case member 9*a* and the cover 9*b* to easily produce the second case half 9, thereby contributing to cost reduction.

In addition, when the case member 9*a* and the cover 9*b* constituting the second case half 9 are coupled to each other, the current-carrying terminal 37 of the electric motor 11 is connected to the power feeding circuit 35 by the connector 36. Therefore, it is possible to eliminate a special step of connecting the electric motor 11 to the power feeding circuit 35 and to prevent forgetting of connecting them, leading to an improvement in assemblability.

When the engine intake control system is mounted on the engine, a power source and an electronic control unit are connected to the coupler 39. The electric motor 11 is operated in accordance with the amount of operation of an accelerator-operating member of an automobile or a motorcycle, and the rotation or reversion of the output shaft 11*b* of the electric motor 11 is transmitted to the throttle valve 3 through the speed reduction device 12, thereby opening or closing the throttle valve 3. The opening degree of the throttle valve 3 is detected by the sensor stator 33 through the sensor rotor 32, and fed back to the electronic control unit.

The final gear 15 having the sensor rotor 32 secured thereto is integral with the valve shaft 3*a* of the throttle valve 3. Therefore, the sensor stator 33 attached to the sensor-supporting portion 29 of the cover 9*b* accurately detects the opening degree of the throttle valve 3 through the sensor rotor 32, and the electric motor 11 can accurately control the opening degree of the throttle valve 3 based on a detection signal from the sensor stator 33.

Further, the fully-closed position of the throttle valve 3 is defined by the abutment between the stopper face 26 of the final gear 15 integral with the valve shaft 3*a* of the throttle valve 3 and the fully-closing stopper 27 integral with the throttle body 1. Therefore, the fully-closed position of the throttle valve 3 is always stable, and hence it is possible to accurately provide an idling opening degree of the throttle valve 3 which is determined on the basis of the fully-closed position. This can contribute to a reasonable idling of the engine, and further a reduction in fuel consumption.

Furthermore, the bracket 42 supporting the end of the electric motor 11 is integrally formed upon the coupling of the first and second case halves 8 and 9, that is, the end of the electric motor 11 is supported utilizing the throttle body 1, thereby suppressing the generation of vibrational noise of the electric motor 11 during operation of the electric motor 11.

Although the preferred embodiment of the present invention has been described, the present invention is not limited to the above-described embodiment, and various modifications in design may be made without departing from the subject matter of the invention.

What is claimed is:

1. An engine intake control system comprising:

an intake passage leading to an intake port of an engine; and an electric motor disposed on one side of a throttle body which rotatably supports a valve shaft of a throttle valve for opening and closing the intake passage, an output shaft of the electric motor being connected to the valve shaft through a speed reduction device for reducing the rotation of the output shaft and transmitting it to the valve shaft, wherein the system further comprises a transmitting case including a first case half integrally formed on one side of the throttle body, and a second case half coupled to the first case half;

wherein a first assembly is constructed by disposing a final gear inside the first case half and securing it to one end of the valve shaft;

wherein a second assembly is constructed by mounting on the second case half the electric motor and an intermediate gear of the speed reduction device for transmitting the rotation of the output shaft of the electric motor to the final gear;

wherein the first case half and the second case half are coupled to each other to connect together the first and second assemblies, and wherein the intermediate gear and the final gear are meshed with each other.

2. An engine intake control system according to claim 1, wherein the second case half is divided into a case member which supports the electric motor and houses the intermediate gear, and a cover coupled to the case member so as to cover an outer surface of the case member; and at least one of the case member and the cover is made of a synthetic resin.

3. An engine intake control system according to claim 2, wherein a throttle sensor is constructed by a sensor rotor secured to the final gear and a sensor stator attached to the cover to detect the opening degree of the throttle valve through the sensor rotor; and the cover is provided with a power feeding circuit and a connector which connects a current-carrying terminal of the electric motor to the power feeding circuit upon coupling of the cover and the case member.

4. An engine intake control system for an engine according to claim 3, wherein the first case half is provided with a fully-closing stopper for receiving a stopper face formed on the final gear to define a fully-closed position of the throttle valve.

5. An engine intake control system according to claim 4, wherein the throttle body is integrally formed with a bracket which supports an end of the electric motor upon coupling of the first and second case halves.

6. An engine intake control system according to any of claims 1 to 3, wherein the throttle body is integrally formed with a bracket which supports an end of the electric motor upon coupling of the first and second case halves.

7. An engine intake control system for an engine according to claim 1 or 2, wherein the first case half is provided with a fully-closing stopper for receiving a stopper face formed on the final gear to define a fully-closed position of the throttle valve.

8. An engine intake control system according to claim 7, wherein the throttle body is integrally formed with a bracket which supports an end of the electric motor upon coupling of the first and second case halves.

* * * * *